US006302273B1

(12) United States Patent
Edmunds

(10) Patent No.: US 6,302,273 B1
(45) Date of Patent: Oct. 16, 2001

(54) APPARATUS FOR AIDING THE LAYOUT AND EDITING OF ITEMS OF SHEET MATERIAL

(76) Inventor: Richard John Edmunds, 41b Landsdowne Crescent, London (GB), W11 2NT ( * ) Notice: Subject to any disclaimer, the term of this patent is extended or adjusted under 35 U.S.C. 154(b) by 0 days.

(21) Appl. No.: 09/511,657

(22) Filed: Feb. 22, 2000

(30) Foreign Application Priority Data

Jan. 25, 2000 (GB) ..... 0001713

(51) Int. Cl.[7] ..... B65D 69/00; A45C 11/36; A47B 97/04

(52) U.S. Cl. ..... 206/575; 190/16; 190/107; 248/447; 248/461; 312/231; 434/88

(58) Field of Search ..... 206/575; 190/1, 190/16, 107; 248/444, 447, 447.1, 457, 460, 461; 281/33; 312/230–232, 244; 434/88

(56) References Cited

U.S. PATENT DOCUMENTS 1,962,988 * 6/1934 Fulton ..... 312/231
2,638,397 * 5/1953 Wykoff ..... 312/231
3,168,363 * 2/1965 Monsour ..... 312/231
3,669,227 * 6/1972 Alford ..... 190/11
3,797,138 * 3/1974 Linker et al. ..... 190/166
4,093,326 * 6/1978 Ford ..... 312/231
4,372,630 * 2/1983 Fuhri ..... 312/231
5,655,651 * 8/1997 Maier ..... 312/231 X
5,922,458 * 7/1999 Herlihy ..... 428/343

* cited by examiner

*Primary Examiner*—Bryon P. Gehman
(74) *Attorney, Agent, or Firm*—Thomas M. Freiburger

(57) ABSTRACT

Apparatus (10) for aiding the layout and editing of items of sheet material, comprising a portable case (12) composed of a plurality of panel units (14,15,16) hingedly coupled to one another such as to form, when folded together, a closed container. The closed case (12) contains a plurality of tabular elements (24,25,26), at least one of which is co-operable with a panel unit (14,15) such as to be erectable into an easel-like state when the case (12) is open with a panel unit (14,15) providing support for the tabular element (24,25) in an inclined position. This or another one of the tabular elements (25) may be provided with a repeatably adherent adhesive substance (54) of low adhesion to permit peeling off therefrom of items of sheet material temporarily mounted thereon. Another one of the tabular elements (26) supports, when the case is open, a cutting device (62) for trimming the items of sheet material to desired sizes.

6 Claims, 2 Drawing Sheets

APPARATUS FOR AIDING THE LAYOUT AND EDITING OF ITEMS OF SHEET MATERIAL

TECHNICAL FIELD

This invention relates to apparatus for aiding the layout and/or editing of items of sheet material, particularly, (but not exclusively) such sheet material bearing indicia, e.g. wording and/or pictures (drawings, paintings, prints or photographs).

It is known to arrange pictorial elements (drawings, paintings, prints or photographs)in a selected position or array on a sheet, and then to place such sheet in a file, folder or book for subsequent viewing. Generally this activity requires considerable table space and, if interrupted because, say, the table is required for some other purpose, results in considerable disruption as elements not yet selected for mounting on sheets have to be repacked into their previous store and partially-completed sheets have to be placed in some intermediate place or an inappropriate position in the file, folder or book.

With a view to ameliorating these and/or other difficulties one aspect of the present invention provides apparatus for aiding the layout and/or editing of items of sheet material, wherein said apparatus comprises a portable case composed of a plurality of panel units hingedly coupled to one another such as to form a closed container when folded together, said case, when closed, containing a plurality of tabular elements, at least one of said tabular elements being co-operable with a said panel unit such as to be erectable into an easel-like state when the said case is open with said panel unit providing support for said tabular element in an inclined position.

Preferably the angle of inclination of said tabular element is adjustable.

Preferably, one of said tabular elements is provided with a repeatably adherent adhesive substance of low adhesion to permit peeling off from the one tabular element of items of sheet material temporarily mounted thereon. This permits mounting of the items in a variety of trial positions before a suitable positional relationship or montage is decided upon and finally selected.

Advantageously one (preferably another) of said tabular elements is provided with a plurality of ledges to support loose items of sheet material to be sorted (and/or applied to the repeatedly adherent adhesive substance). The ledges may be provided by the lower limbs of generally L-section elements protruding from one face of the said tabular element.

Preferably, one (with advantage, a further tabular element) supports, when the case is open (i.e. the panels are unfolded), a cutting device for trimming said items of sheet material to desired sizes.

BRIEF DESCRIPTION OF THE DRAWINGS

By way of example one embodiment of this invention will now be described with reference to the accompanying drawings of which.

DETAILED DESCRIPTION OF EXAMPLE(S) OF THE INVENTION

The illustrated apparatus 10 for use as a portable composition aid, i.e. for aiding a user in the layout and/or editing of items of sheet material. A particular, (but not exclusive) use for the portable composition aid 10 is with sheet material bearing indicia, e.g. wording and/or pictures—including drawings, paintings, prints or photographs.

Figure 1:
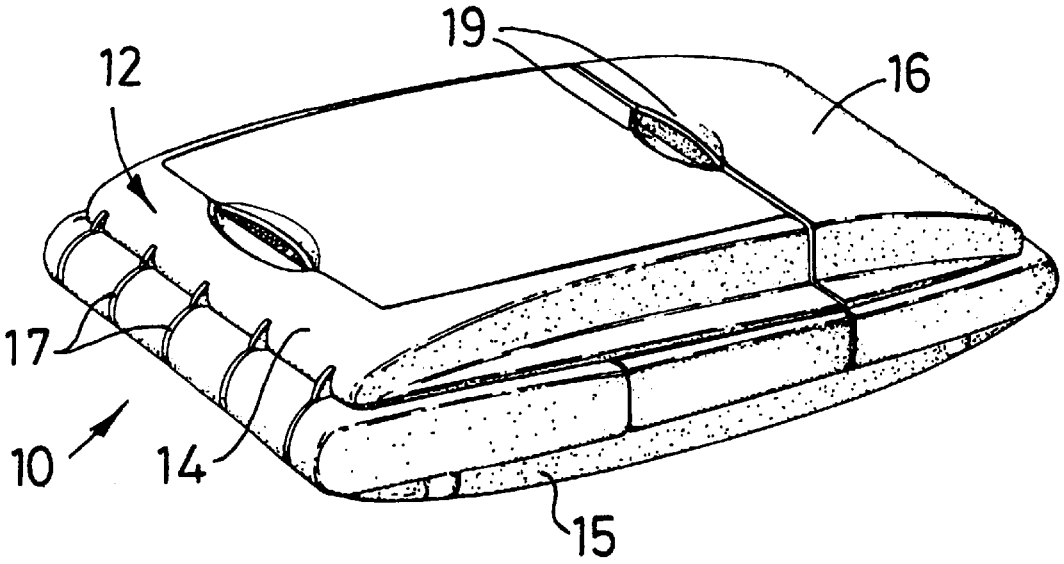
FIG. 1 is a schematic perspective view from above and one side of said embodiment in a fully closed condition.
Figure 2:
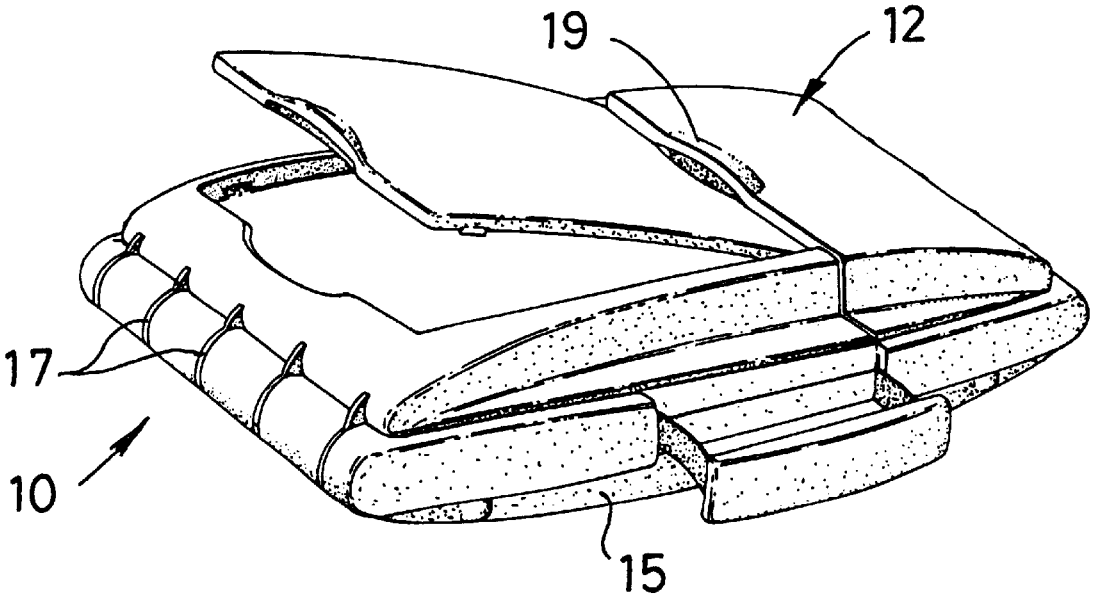
FIG. 2 is a similar view to FIG. 1 of said embodiment in a partly open condition.

The apparatus 10 comprises a case 12 having a plurality of main panel units 14,15 and 16 molded of plastics material with each panel unit of somewhat tray-like recessed form, the recesses facing inwardly of the closed case 12. The panel unit 15 is generally frusto-triangular outline with its two inclined edge portions pivotally connected by hinges 17,18 to two opposite end panel units 14,16. The latter are shaped and dimensioned such that they can be folded over the intermediate panel unit 15 and fastened to one another and/or to panel unit 15 to provide a closed condition for the case 12. Such fastening may be by detent devices molded integrally with the panel units 14–16 to provide snap-fitting inter-engagement due to the inherent resiliency of parts of the detent devices. The edge portions of the end panel unit 14 and/or of the end panel 16 may be provided with a semi-oval indent 19 (two opposed such indents are shown in FIG. 1) to permit gripping insertion of the user's fingers to open the case 12 by pulling and overcoming the locking action of the detent devices.

Figure 3:
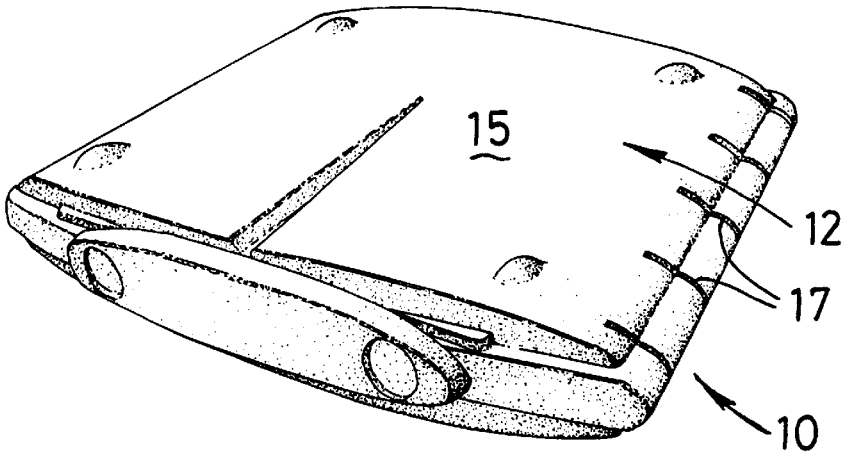
FIG. 3 is a schematic perspective view from below and the other side of the said embodiment.
Figure 4:
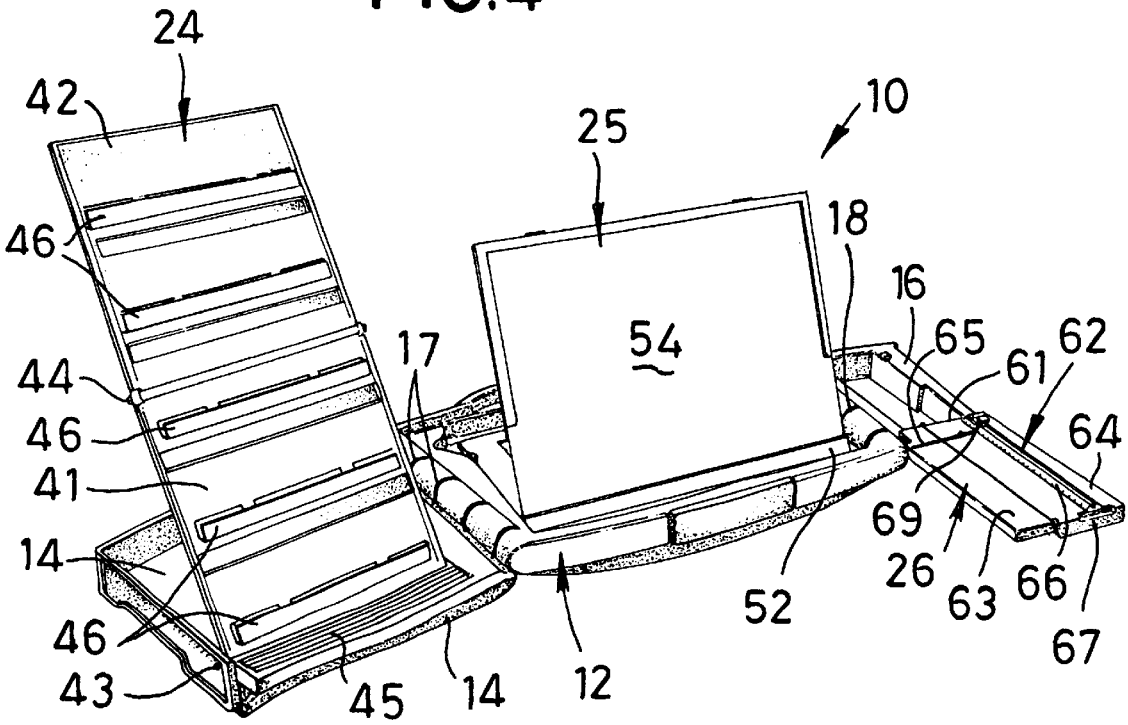
FIG. 4 is a schematic perspective view from above and one side of said embodiment in a fully open and erected condition.

The outer face of panel unit 15 is provided with four protrusions 13 (FIG. 3) so that when in the case-open condition shown in FIG. 4, the panel units 14,15,16 can lie in a generally horizontal plane. In this open condition, internal tabular elements 24,25,26 are revealed that are either provided by or are contained within the interior of the panels 14,15,16 respectively.

Tabular element 24 is selectively movable between a stowed, out of use condition within the tray-like form of unit 14 and an erected in use condition in which it is elevated and inclined to the generally horizontal plane of units 14–16. Erected element 24 comprises a pair of rack units 41,42, disposed one above the other in a generally common inclined plane, the lower edge of bottom rack unit 41a being pivotally connected at 43 to a forward part of the recess of panel unit 14, and the upper edge of bottom rack unit 41 being pivotally connected at 44 to the lower edge of the upper rack unit 42. This allows the two rack units 41,42 to be folded over one another and stowed within the tray-like recess of the end panel unit 14 (and occupy an out-of-use condition). Each of the rack units 41,42 is integrally molded with a plurality of elongate L-section support strips 46 for use in supporting a plurality of items of sheet material (that are to be edited or subjected to layout composition) in rows and therealong in easily viewable positions. The forward part of panel unit 14 is provided with a plurality of grooves 45 any one of which can accommodate additional or reserve items of sheet material prior to their being supported and temporarily arranged in rows upon the elongate L-section support strips 46.

A flat stay (not shown) is pivotally attached by its upper end to the rear face of lower rack unit 41, and the lower end of this stay (when pivoted away from that rear face) is engageable with a protrusion upstanding from the base of the tray-like recess of each panel unit 14 to hold rack units 41,42 in their erect inclined condition.

Tabular element 25 may be likewise movable pivotally from out of the tray-like recess of intermediate panel unit 15. In one arrangement, tabular element 25 may have a bottom edge that is to be located in a groove (or in a selected one of a plurality of grooves) to adopt a particular inclined position. Alternatively, the tabular element 25 may be hinged at 52 directly to the panel unit 15 and a pivoted stay (not shown) extending between the panel unit 15 and the underside of tabular element 25 serves to hold tabular element 25 in its elevated (i.e. inclined) in-use condition. The tabular element 25 supports a pad of sheets 54 each provided with a repeatably adherent adhesive substance of low adhesion to permit peeling off from the uppermost sheet 54 items of sheet material temporarily mounted thereon. This permits mounting of the items in a variety of trial positions before a suitable positional relationship or montage is arrived at, decided upon and findally selected. To assist in such positioning, the sheets 54 of said pad may be provided with markings corresponding to or indicative of a grid or like array.

In an alternative arrangement the pad 54 is omitted and the front face of tabular element 25 is itself provided with said repeatably adherent adhesive substance.

Tabular element 26 is a cutting board that is pivoted to the front edge portion 61 of the tray-like recess of end panel unit 16 and, when unfolded forwardly to its opened in-use condition, lies horizontally to permit access to its cutter device 62. The cutting board is provided by two parts 63,64, hinged to one another to pivot about their mutually adjacent longitudinal edges in the manner of a book and, when opened out, provide a common horizontal support surface for an item to be trimmed or cut by device 62. The latter comprises a ruler 66 which has a lateral extension 67 at each end pivoted to the outer cutting board part 64 whereby the ruler 66 can be pivotally raised off from the horizontal support surface provided by the cutting board's parts 63,64. The cutter device's ruler 66 has a longitudinal slot therein and a block 69 mounted slidably within this slot. A small cutting wheel or blade protrudes downwards from the underside of block 69 and extends into an elongate groove provided therebeneath in cutting board part 64. Thus, as block 69 is slid along ruler 66 the cutting wheel or blade can run along the elongate groove. The two parts 63,64 are provided with a rib or ridge 65 extending along a common line at right angles to the groove and path of the cutting wheel or blade. This rib or ridge 65 provides an abutment for one edge of an item of sheet material that is to be cut by the cutter device 62 (after being inserted beneath the ruler 66).

Other modifications and embodiments of the invention, which will be readily apparent to those skilled in this art, are to be deemed within the ambit and scope of the present invention, and the particular embodiment(s) hereinbefore described may be varied in construction and detail, e.g. interchanging (where appropriate or desired) different features of each, without departing from the scope of the patent monopoly hereby sought. For example the panels and/or tabular elements may be fabricated from metal or other materials and need not be moldings of plastics material of the form illustrated in the accompanying drawings.

What is claimed is:

1. Apparatus for aiding the layout and editing of items of sheet material bearing at least one printed image, said apparatus comprising a portable case composed of a plurality of units, and articulation means hingedly coupling said units to one another such that said units form a closed container when folded together, wherein:

a first of said units includes a first tabular element having a base edge and erectable to an inclined position with said base edge lowermost, said first of said units is provided with a plurality of generally horizontal ledges to support in use loose items of sheet material to be sorted, said ledges are located at intervals spaced apart in a direction away from the base edge of said first tabular element, a second of said units includes a second tabular element having a base edge and erectable to an inclined position with the base edge thereof lowermost, and wherein the second tabular element is provided with a repeatably adherent adhesive substance of low adhesion to permit peeling off therefrom of items of sheet material that have been temporarily mounted thereon.

2. Apparatus according to claim 1, further comprising:

a pad of sheets, each of said sheets presenting, when revealed, a repeatably adherent adhesive substance of low adhesion to permit peeling off therefrom of items of sheet material that have been temporarily mounted thereon, and means mounting said pad of sheets to said second tabular element to present a revealed sheet uppermost thereon and in a manner permitting ready removal of that uppermost sheet when its adherent properties become unsatisfactory.

3. Apparatus according to claim 1, wherein said first tabular element has a front face and an opposite rear face, said front face having a plurality of elements extending away from said front face and constituting said ledges.

4. Apparatus according to claim 1, wherein a third of said plurality of units includes a support element, a cutting device for trimming an item of sheet material to a desired size, a ridge defined by the support element to be in use abutted by an edge of the item to be trimmed, and means mounting said cutting device on the support element of said third unit for guided linear travel perpendicular to said ridge.

5. Apparatus for aiding the layout and editing of items of sheet material bearing at least one printed image, said apparatus comprising a portable case composed of first, second and third units, and articulation means hingedly coupling said units to one another such that said units form a closed container when folded together, wherein:

the first unit includes a first tabular element having a base edge and erectable to an inclined position with said base edge lowermost, the first unit is provided with a plurality of generally horizontal ledges to support in use loose items of sheet material to be sorted, said ledges are located at intervals spaced apart in a direction away from the base edge of said first tabular element, the second unit includes a second tabular element having a base edge and erectable to an inclined position with the base edge thereof lowermost, the second unit is provided with a repeatably adherent adhesive substance of low adhesion to permit peeling off therefrom of items of sheet material that have been temporarily mounted thereon, and wherein the third unit includes a support element, a cutting device for trimming an item of sheet material to a desired size, a ridge defined by the support element to be in use abutted by an edge of the item to be trimmed, and means mounting said cutting device on the support element of said third unit for guided linear travel perpendicular to said ridge.

6. Apparatus according to claim 5, wherein said first tabular element has a front face and an opposite rear face, said front face having a plurality of elements extending away from said front face of the first tabular element and constituting said ledges.

* * * * *